US005261844A

United States Patent [19]

Shibata

[11] Patent Number: 5,261,844

[45] Date of Patent: Nov. 16, 1993

[54] THROTTLE OPENING CONTROL DEVICE FOR MARINE PROPULSION DEVICE

[75] Inventor: Yasuhiko Shibata, Hamamatsu, Japan

[73] Assignee: Sanshin Kogyo Kabushiki Kaisha, Hamamatsu, Japan

[21] Appl. No.: 834,930

[22] Filed: Feb. 13, 1992

[30] Foreign Application Priority Data

Feb. 14, 1991 [JP] Japan ..... 3-42473

[51] Int. Cl.[5] ..... B63H 21/28

[52] U.S. Cl. ..... 440/87; 440/86; 440/1; 74/480 B

[58] Field of Search ..... 440/84, 86, 87, 1, 900; 74/480 B, 480 R, 479, 484 R, 872, 874–876, DIG. 2, DIG. 8

[56] References Cited

U.S. PATENT DOCUMENTS

| | | | |
|---|---|---|---|
| 3,250,350 | 5/1966 | Shimanckas | 74/876 |
| 3,309,938 | 3/1967 | Pervier | 74/876 |
| 4,090,598 | 3/1978 | Prince | 74/876 |
| 4,205,738 | 6/1980 | Baba | 74/876 |
| 4,925,416 | 5/1990 | Oishi | 440/87 |
| 5,050,461 | 9/1991 | Onoue | 440/86 |
| 5,083,951 | 1/1992 | Baba | 440/87 |

*Primary Examiner*—Robert J. Oberleitner
*Assistant Examiner*—Clifford T. Bartz
*Attorney, Agent, or Firm*—Ernest A. Beutler

[57] ABSTRACT

The present invention provides an improved throttle opening control device for a marine propulsion arrangement. The invention allows an operator of a marine propulsion unit to shift from a forward or reverse operating state into neutral, in order to start or restart an engine, or to effect an urgent transmission shift change during operation, without having to execute an independent step of separately reducing the throttle opening beforehand. According to the present invention, the angle of throttle opening is automatically controlled by an interconnection to the transmission shifting system of the propulsion arrangement.

10 Claims, 6 Drawing Sheets

THROTTLE OPENING CONTROL DEVICE FOR MARINE PROPULSION DEVICE

BACKGROUND OF THE INVENTION

The present invention relates to a throttle opening control device for a marine propulsion arrangement, and more particularly to a device which may be utilized in connection with the propulsion arrangement of an outboard motor, wherein the angle of throttle opening may be regulated, and automatically controlled, by an interconnection to the transmission shifting system.

The induction systems for many internal combustion engines frequently employ throttle valves. Throttle valves control the air flow through the induction passages of respective charge forming devices. The position of the throttle valves, and thus the amount of air inducted, may be controlled by an operator by way of a remote shift-type lever or a remote rotatable hand grip, for example, as upon the tiller of an outboard motor.

It has been known to interrelate the operation of such a throttle control arrangement with the operation of a transmission system, having forward, neutral, and reverse operating stages, in order to avoid certain problems. Problems might be incurred, for example, when attempting to start, or restart, an engine when the throttle is set for a high engine speed, or during an attempt to urgently shift the transmission into another operating stage during engine running conditions. The consequences of such problems might include quick and jerking water vehicle motions, tending to throw passengers off balance, or breakage of the shift control mechanism.

In certain prior types of marine propulsion devices, the transmission may be shifted from forward to neutral, or from reverse to neutral, only when the throttle opening angle is within prescribed safety limits. Also, the engine may be started only when the transmission is in the neutral stage. By employing such arrangements, the above-mentioned potential problems can be avoided.

The above-discussed prior art devices have, however, been recognized as lacking in operational efficiency in certain respects. For example, when operating an engine above idle speeds, before it is fully warmed up, stalling may occur. In accordance with the prior art devices, a two-step procedure must be carried out in order to restart the engine. First, the throttle must oftentimes be adjusted so that its opening angle falls within the prescribed safety limit, as it will likely have been moved outside such limit during operation. Next, the transmission must be shifted from the forward or reverse operating stage to the neutral operating stage. It is only at this point, then, that restarting may be initiated. Similarly, during usual running conditions in order to shift between the various transmission operating stages it is usually necessary, first, to decrease the throttle opening and, then, to make the desired shift. Thus, it is apparent that restarting, as well as shifting operations, can be a cumbersome procedure.

It is, therefore, a principle object of the present invention to provide an improved throttle opening control device for a marine propulsion arrangement.

It is a further object of this invention to provide a device which allows an operator of a marine propulsion unit to shift from a forward or reverse operating state into neutral, in order to start or restart an engine, or to effect an urgent transmission shift change during operation, without having to execute an independent step of separately reducing the throttle opening angle beforehand.

It is still a further object of this invention to provide a throttle opening control arrangement wherein the angle of throttle opening is automatically controlled by an interconnection to the transmission shifting system.

SUMMARY OF THE INVENTION

The present invention provides a throttle opening control arrangement adapted to be embodied in a marine propulsion unit. The invention comprises a transmission system having an operative driving stage and a neutral stage. A transmission system shift arrangement communicates with, and is operable to control, the transmission system. The invention further comprises an engine and an induction system. The induction system supplies a charge to the engine. A throttling arrangement is associated with the induction system for controlling the constitution of the charge. A throttle control arrangement is provided which communicates with the throttling arrangement and is operable to adjust a set throttle opening angle of the throttling arrangement. The invention additionally comprises a throttle position regulating system which interlinks the transmission system shift arrangement with the throttle control arrangement. The throttle position regulating system is operable to automatically determine a permissible range of throttle opening and, further, is operable to automatically decrease the angle of throttle opening upon shifting the transmission system from its operative driving stage to its neutral stage, solely in response to movement of the transmission system shift arrangement.

DETAILED DESCRIPTION OF THE PREFERRED EMBODIMENT

Figure 1:
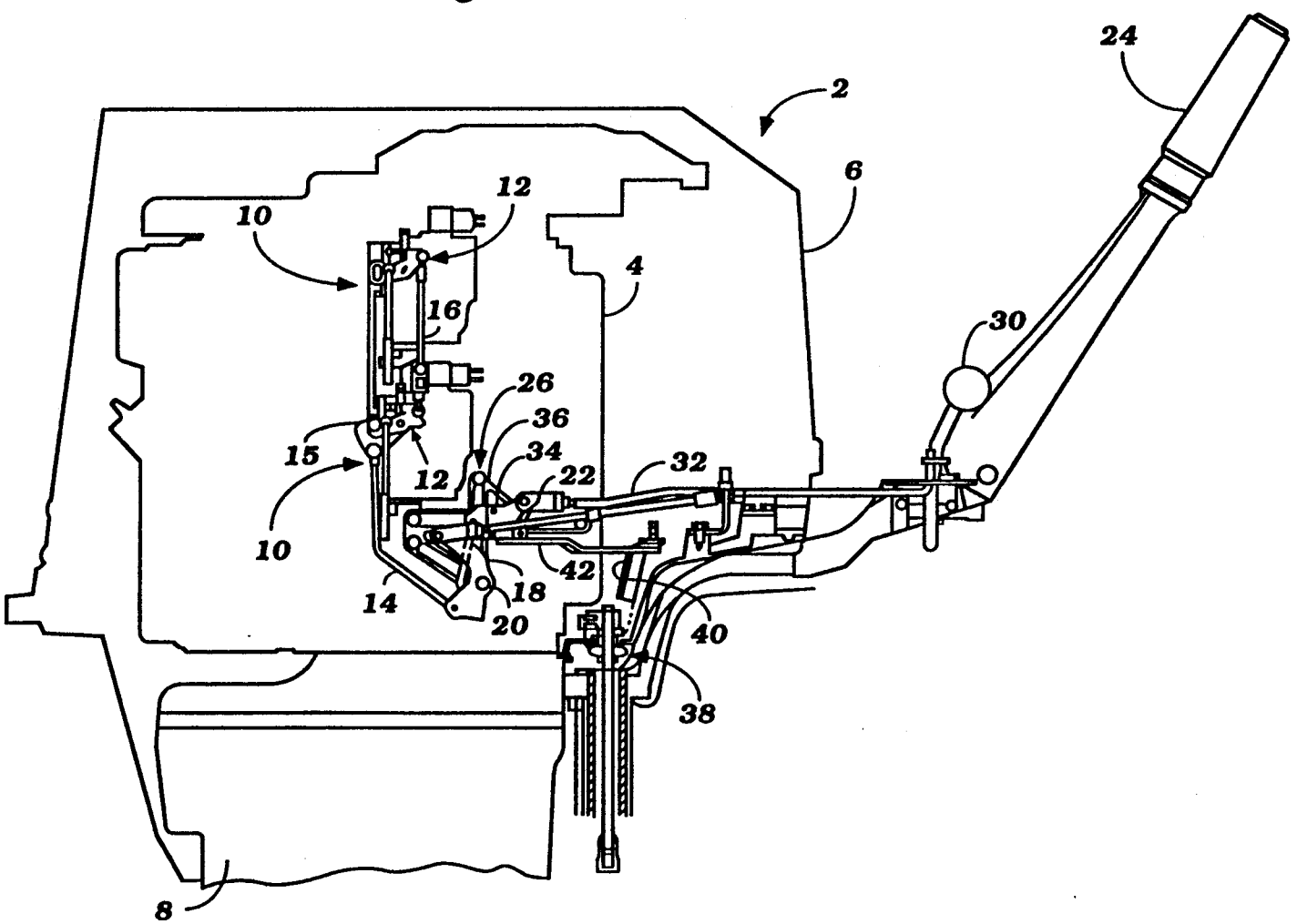
FIG. 1 is a side elevational view of a throttle opening control device constructed in accordance with the present invention and as embodied in an outboard-type marine propulsion unit.
Figure 2:
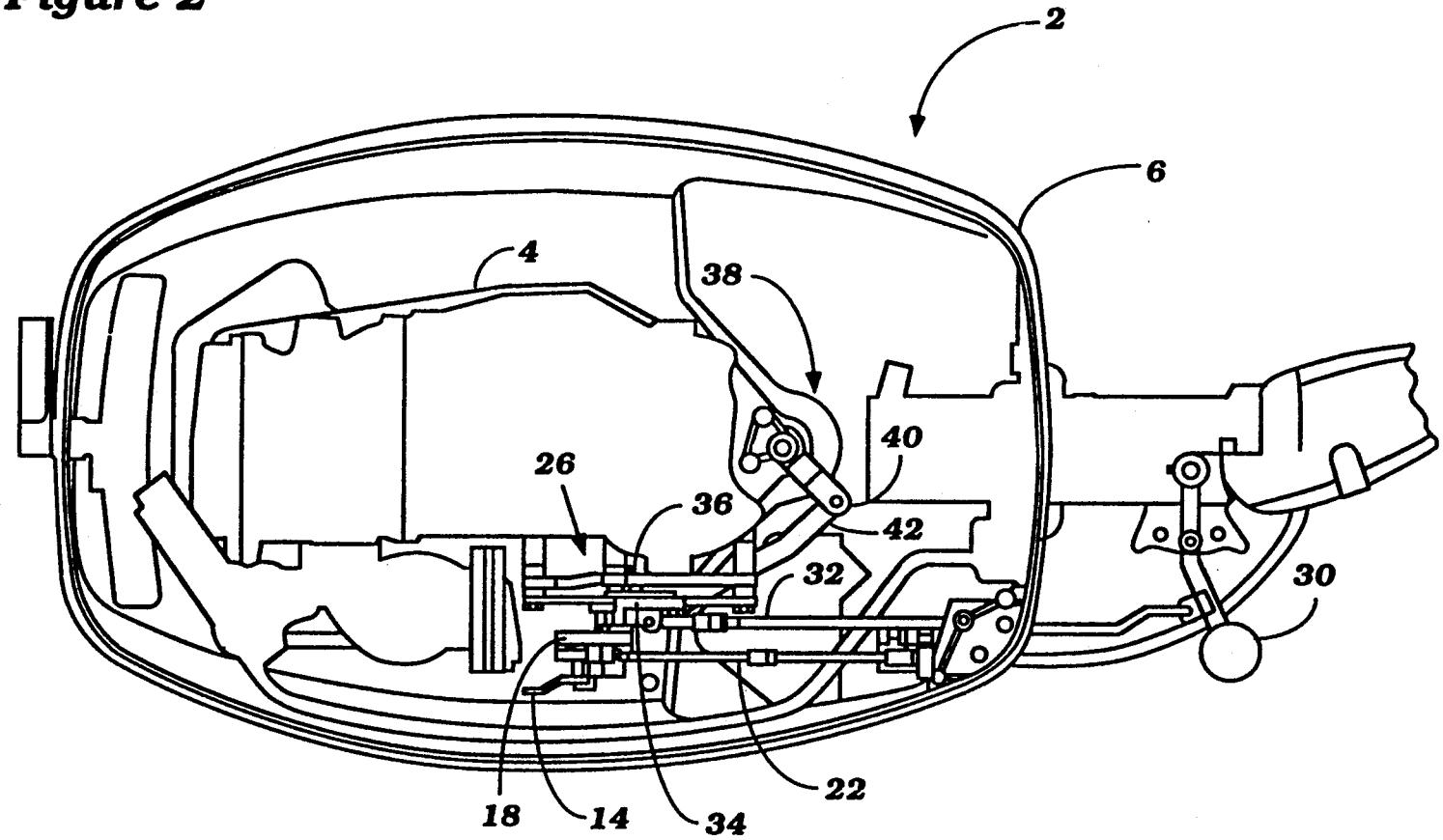
FIG. 2 is a top plan view of the arrangement illustrated in FIG. 1.

Referring initially to FIGS. 1 and 2, a side elevational view and a top plan view are shown, respectively, of a throttle opening control device constructed in accordance with the present invention, and as embodied in an outboard motor type marine propulsion unit. Such an embodiment is typical of the environments in which the invention can be utilized. It is to be understood, however, that the invention can be employed in conjunction with other propulsion arrangements, such as an inboard-outboard watercraft propulsion system, and with other uses for internal combustion engines and their throttle valve mechanisms.

In the illustrations, the outboard motor is identified generally by the reference numeral 2. The outboard motor 2 includes a power head consisting of an internal combustion engine 4 and a surrounding protective cowling 6. The engine may be of any known type; for example, an engine operating on the twostroke crankcase compression principle would be suitable.

As is conventional with outboard motor practice, the engine 4 is disposed so that its output shaft (not shown) rotates about a vertically extending axis and is coupled to a drive shaft (not shown) that is journalled within a drive shaft housing 8. A lower unit (not shown), which is located beneath the drive shaft housing 8, contains a forward, neutral, reverse transmission (not shown) so that the drive shaft may drive a propeller (not shown) in selected forward and reverse directions, as is well known in this art. It is to be understood that the invention may also be practiced with a transmission provided with other than solely a forward, neutral and reverse gear system.

The engine 4 is supplied with charge forming devices 10 which are depicted as being of the carburetor type and include respective butterfly-type throttle valves 12 which are affixed to throttle valve shafts for movement thereabout. A manually controlled throttle linkage system cooperates with the carburetors 10 for controlling their throttle valves 12. The throttle linkage system includes a throttle rod 14 which is connected to a lever 15 which drives one of the throttle valves 12, which is a directly driven throttle valve. Movement of the throttle rod 14, thus, controls the rotational movement of the driven throttle valve. The further throttle valve 12 is a slave valve and its rotational movement is controlled by a further linkage arrangement 16 emanating off of the driven valve. The throttle rod 14 is connected to one end of a generally L-shaped throttle control lever 18 and is, in turn, driven by the movement of the L-shaped throttle control lever 18 which is pivotal about a shaft 20. The other end of the L-shaped throttle control lever 18 is connected to a throttle control cable 22. Movement of the control cable 22 may be manually determined by a remote, operator controlled throttle device, such as a rotatable tiller handgrip 24. The degree of throttle opening is adjusted in proportion to the degree of rotation of the throttle control lever 18. It should be noted that the throttle control lever could be of a directly driven type instead of remotely operated.

Next, the throttle opening control arrangement 26, wherein the angle of throttle opening is automatically controlled by an interconnection to the transmission shifting system, as contemplated by the present invention, will be discussed.

As shown in FIGS. 1 and 2, a remote transmission shift lever 30 is provided along a forwardly located area of the marine propulsion unit 2, with respect to an associated watercraft (not shown). The transmission shift lever 30 is positioned in such a manner that it is readily accessible to an operator for running the watercraft. A shift control cable 32 mechanically interlinks the shift lever 30 with a slider member 34 which is disposed for linear reciprocal movement along a guide 36.

A shifting apparatus 38 is disposed beneath the slider member 34 and associated guide 36. The shifting apparatus 38 operates to shift the transmission of the propulsion unit 2 between its various operating stages (e.g., forward, neutral and reverse) by way of a rotating movement of the shifting apparatus 38. A shift rod lever 40 extends outwardly and upwardly of a generally vertically extending shaft of the rotatable transmission assembly 38. An elongate shift plate 42 mechanically interlinks the slider member 34 and the shift rod lever 40 so that linear movement of the slider member 34 imparts a rotational movement to the shift rod lever 40 via the shift plate 42. As just described, such rotational movement of the shift rod lever 40 ultimately effects gear changes within the transmission of the propulsion unit 2 by rotating the shift device 38.

Figure 3:
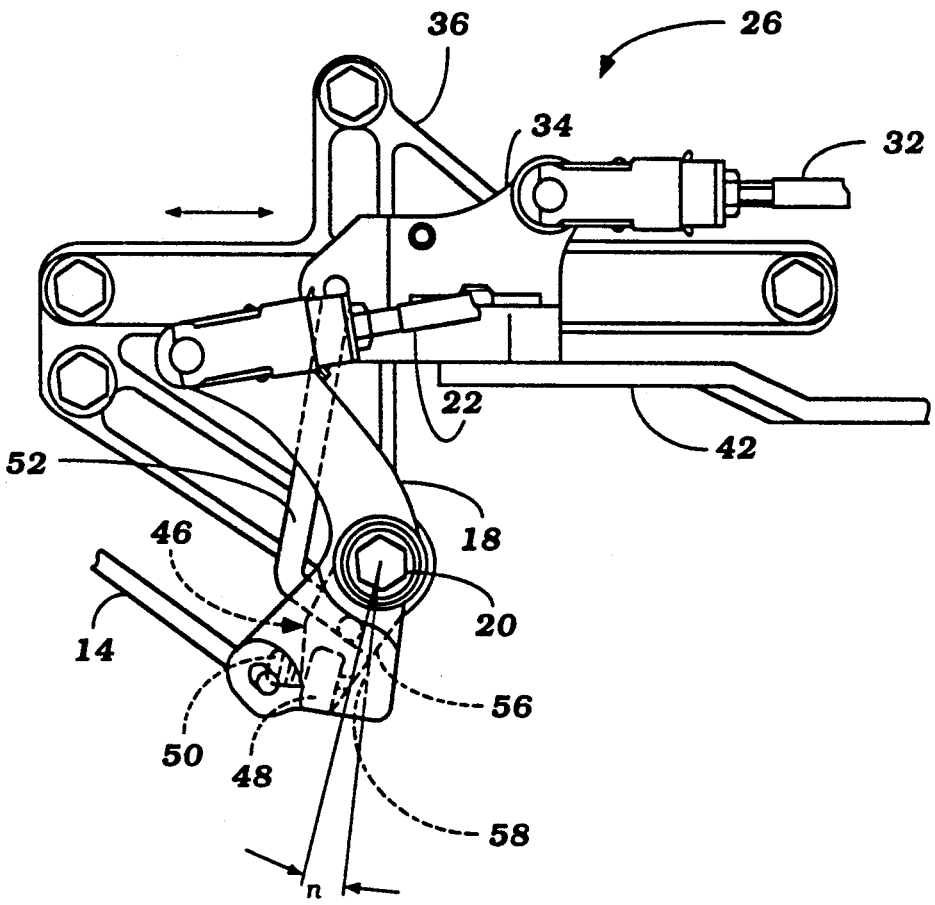
FIG. 3 is an enlarged side elevational view of the throttle opening control device of the invention when the transmission of the marine propulsion unit is in its neutral operating stage.
Figure 4:
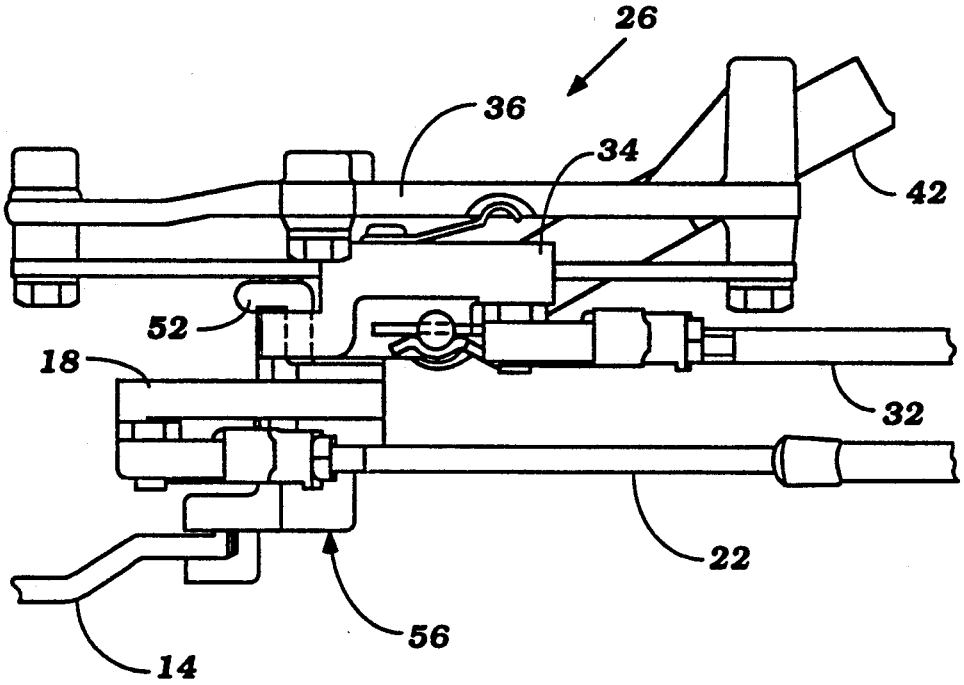
FIG. 4 is a top plan view of the arrangement illustrated in FIG. 3.

With additional reference to FIGS. 3 and 4, which show the throttle opening control device of the invention when the transmission of the marine propulsion unit is in its neutral operating state, it can be seen that the throttle control lever 18 is located beneath the slider member 34 for rotation about an axis defined by shaft 20. A throttle stopper member 46 is also disposed beneath the slider member 34 and is rotatable about the axis defined by the shaft 20. A projection 48 is located to one end of the throttle stopper member 46. The projection 48 is provided with a threaded hole therethrough for receiving a bolt member 50. The bolt member 50 is a set bolt which is adjustable via its rotation within the threaded hole so that the throttle opening angle may be regulated, as will be described below.

A connecting rod 52 mechanically interlinks the slider member 34 and the throttle stopper member 46 so that the position of the throttle stopper member 46 about its axis of rotation, and thus the disposition of the associated projection 48 and set bolt 50, can be determined according to the position of the slider member 34. The throttle control member 18 is provided with a stepped portion 56, having a working face region 58, along its lower end. The working face 58 is disposed so that it will contact an abutting end of the set bolt 50, under certain operating conditions to be discussed, which will impede further rotational movement of the throttle control member 18 in a direction tending to increase the angle of throttle opening. In this way, a limited angle of rotation for the throttle control lever 18 can be set. By adjusting the position of the set bolt 50, via its rotation within its threaded holder, this angle can be fine tuned within a range determined by the adjusting length of the set bolt 50.

Next, the operation of the throttle opening control device 26 under dynamic operating conditions, wherein the transmission is operated initially in forward, then to neutral, and finally to reverse, will be set forth.

Figure 5:
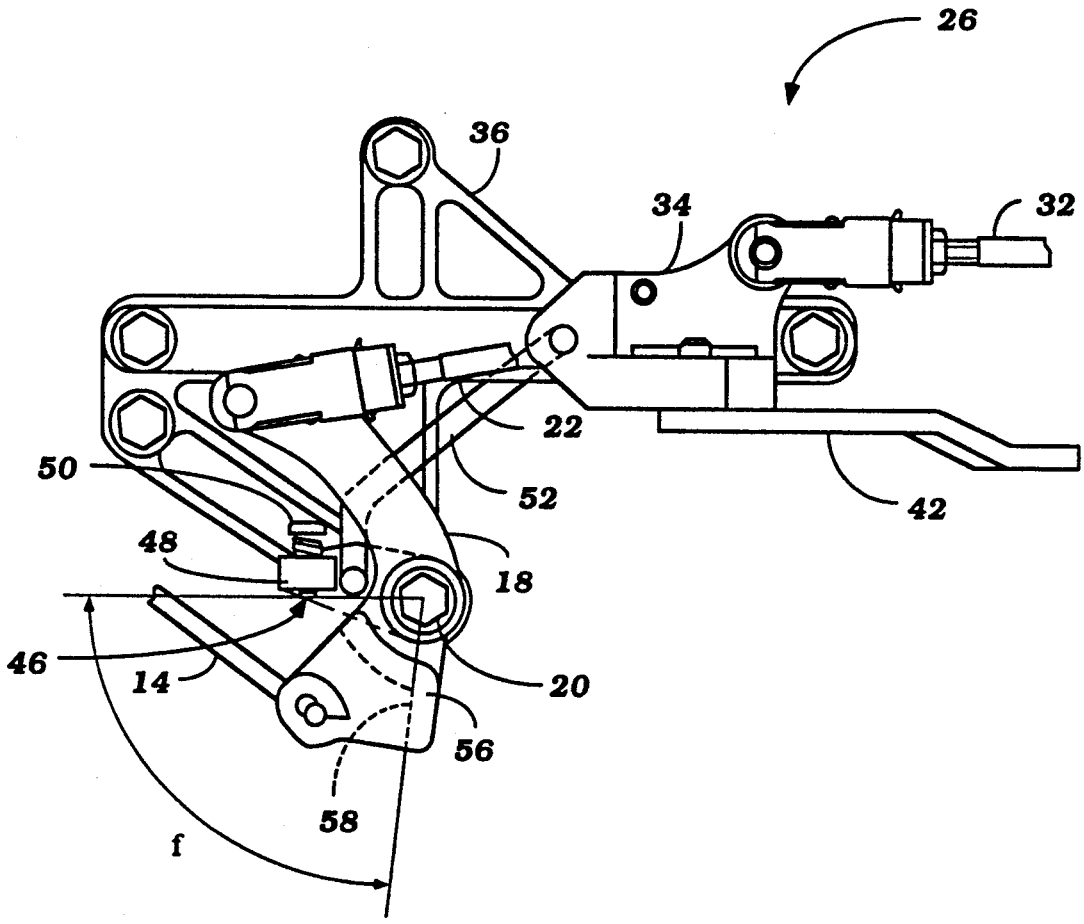
FIG. 5 is an enlarged side elevational view of the throttle opening control device of the invention when the transmission of the marine propulsion unit is in its forward operating stage.

FIG. 5 is a side elevational view of the throttle opening control 26 device when the transmission is in its forward operating state. The slider 34, which is reciprocally movable in a linear fashion backwards and forwards along the guide 36, is located towards the right hand side of the guide 36 in the forward operating state, when viewed in the direction of FIG. 5. The connecting rod 52 acts upon the throttle stopper 46 tending to pull the throttle stopper 46, and its associated set bolt 50, in a direction upwardly and away from the working face 58 of the step 56. Thus, the angle available for throttle opening, defined by the angular distance between the abutting face of the set bolt 50 and the working face 58 of the step 56 about the central axis of the shaft 20, is set as shown by the reference letter f. Accordingly, the throttle control lever 18 can be rotationally adjusted, via the remote, operator throttle control 24, through the angle f during forward operation of the marine propulsion unit 2.

With reference, once again, to FIGS. 3 and 4, the slider 34 becomes positioned centrally along the guide 36 when the transmission is shifted from forward into the neutral operating state. Such movement of the slider 34 causes the throttle control lever 18 to move downwardly by way of the resultant simultaneous movement imparted to the connecting rod 52 located therebetween. If the throttle's position during forward operation, just prior to the shifting of the transmission into neutral, was outside the permitted angular position for neutral operation, the abutting end of the set bolt 50 will contact the working face 58 of the step 56. It is by such contact that the throttle positioning is automatically controlled by shifting of the transmission. In such a case, the throttle control lever 18 will be automatically rotated around towards its closed position, without any independent manual operation of the throttle arrangement. Once in neutral, the angle of permitted throttle movement is that depicted by the reference letter n in FIG. 3, which is, likewise, defined by the angular distance between the abutting face of the set bolt 50 and the working face 58 of the step 56 about the central axis of the shaft 20.

Figure 6:
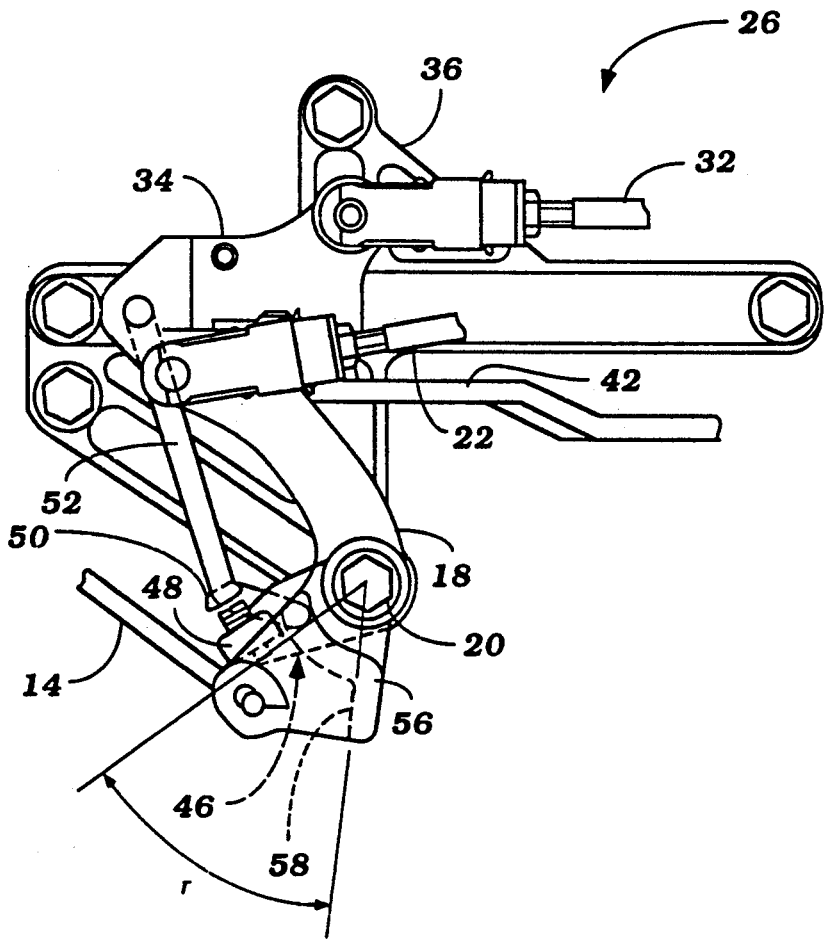
FIG. 6 is an enlarged side elevational view of the throttle opening control device of the invention when the transmission of the marine propulsion unit is in its reverse operating stage.

FIG. 6 is a side elevational view of the throttle opening control device 26 when the transmission is in its reverse operating state. The slider 34 is located towards the left hand side of the guide 36 in the reverse operating state, when viewed in the direction of FIG. 6. The connecting rod 52 acts upon the throttle stopper 46 tending to pull the throttle stopper 46, and its associated set bolt 50, in a direction upwardly and away from the working face 58 of the step 56 when the transmission is shifted from neutral into reverse. Thus, the angle available for throttle opening, defined by the angular distance between the abutting face of the set bolt 50 and the working face 58 of the step 56 about the central axis of the shaft 20, is set as shown by the reference letter r. Accordingly, the throttle control lever 18 can be rotationally adjusted, via the remote, operator throttle control 24, through the angle r during reverse operation of the marine propulsion unit 2.

In addition to the advantages detailed above, the present invention avoids certain transmission shifting errors wherein forces acting in concert with the normal forces involved in effecting a shift result in the inadvertent achievement of an undesired shifting posture. For example, when the throttle is opened, an external force may be imposed, via the connecting rod 52, upon the slider 34. An external force acting upon the slider 34 could conceivably result in a mistaken shift. According to the present arrangement, however, the external force imposed by the connecting rod 52 extends in a direction which is generally perpendicular to the direction of the operational reciprocal movement of the slider 10. Thus, the force transmitted by way of the connecting rod 52 does not have a directional component sufficient to cause a mistaken shift.

Additionally, when the propulsion unit 2 is run in its reverse mode of operation other potential problems are existent. For example, if the throttle is opened to a rather high degree, the propeller might impose a strong thrust force in a direction which opposes a tilt or trim device force tending to angle the propulsion unit somewhat upward. If the propeller thrust force overcomes the tilt or trim device force, the desired tilt or trim angle might become inadvertently decreased. According to the present arrangement, the regulated angle available for opening the throttle during reverse operation, denoted by the reference letter r in FIG. 6, is set so that the propeller thrust force during reverse operation will not be able to overcome the holding force supplied by a tilt or trim device.

It is to be understood that the foregoing description is primarily intended to be exemplary, in particular to provide the preferred embodiment of the invention as contemplated by the inventor, and is not meant to be limiting. Accordingly, various changes and modifications may be made without departing from the spirit and scope of the invention, as defined by the appended claims.

It is claimed:

1. A throttle opening control arrangement for a marine propulsion unit, comprising: a transmission system having an operative driving stage and a neutral stage, a transmission system shift arrangement which communicates with, and is operable to control, said transmission system; an engine, an induction system which supplies a charge to said engine, a throttling arrangement associated with said induction system for controlling the constitution of said charge, a throttle control arrangement which communicates with said throttling arrangement and which is operable to adjust a set throttle opening angle of said throttling arrangement; and a throttle position regulating system interlinking said transmission system shift arrangement with said throttle control arrangement, wherein said throttle position regulating system is operable to automatically determine a permissible range of throttle opening and further, is operable to automatically decrease the angle of throttle opening upon shifting said transmission system from its operative driving stage to its neutral stage solely in response to movement of said transmission system shift arrangement; wherein said throttle position regulating system is located in direct unobstructed proximity to said engine; and further comprising a first operator interfacing device for manual control of said transmission system shift arrangement; and a second operator interfacing device for manual control of said throttle control arrangement, wherein said transmission system shift arrangement includes a slider and a guide, said slider disposed for reciprocal movement along said guide; and a transmission control line extending from said first operator interfacing device to said slider for imparting movement to said slider in accordance with said manual control of said first operating interfacing device; wherein said throttle control arrangement includes a throttle control lever and a first shaft, said throttle control lever rotatable about an axis defined by said first shaft; a throttle control line extending from said second operator interfacing device to a first end of said rotatable throttle control lever; and an elongate throttle rod extending outwardly from a second end of said rotatable throttle control lever towards said throttling arrangement; wherein said throttle control line is a cable.

2. A throttle opening control arrangement for a marine propulsion unit, comprising: a transmission system having an operative driving stage and a neutral stage, a transmission system shift arrangement which communicates with, and is operable to control, said transmission system; an engine, an induction system which supplies a charge to said engine, a throttling arrangement associated with said induction system for controlling the constitution of said charge, a throttle control arrangement which communicates with said throttling arrangement and which is operable to adjust a set throttle opening angle of said throttling arrangement; and a throttle position regulating system interlinking said transmission system shift arrangement with said throttle control arrangement, wherein said throttle position regulating system is operable to automatically determine a permissible range of throttle opening and, further is operable to automatically decrease the angle of throttle opening upon shifting said transmission system from its operative driving stage to its neutral stage solely in response to movement of said transmission system shift arrangement;; wherein said throttle position regulating system is located in direct unobstructed proximity to said engine; and further comprising a first operator interfacing device for manual control of said transmission system shift arrangement; and a second operator interfacing device for manual control of said throttle control arrangement; wherein said transmission system shift arrangement includes a slider and a guide, said slider disposed for reciprocal movement along said guide; and a transmission control line extending from said first operator interfacing device to said slider for imparting movement to said slider in accordance with said manual control of said first operator interfacing device; wherein said throttle control arrangement includes a throttle control lever and a first shaft, said throttle control lever rotatable about an axis defined by said first shaft; a throttle control line extending from said second operator interfacing device to a first end of said rotatable throttle control lever; and an elongate throttle rod extending outwardly from a second end of said rotatable throttle control lever towards said throttling arrangement; wherein said throttle position regulating system includes a stopper member which is rotatable about said axis defined by said first shaft; and a connecting rod interlinking said slider to said stopper member at a location on said stopper member radially outward of said axis defined by said first shaft so that rotational movement is imparted to said stopper member upon movement of said slider via said connecting rod.

3. The throttle opening control arrangement of claim 2 wherein said connecting rod is disposed in a generally perpendicular fashion with respect to the direction of reciprocal movement of said slider.

4. The throttle opening control arrangement of claim 2 wherein said throttle position regulating system further includes a first abutting surface formed upon said stopper member; and a second abutting surface formed upon said throttle control lever; and wherein said first abutting surface and said second abutting surface both sweep along a common arc about said axis defined by said first shaft so that said first abutting surface and said second abutting surface may be brought into abutting contact with one another.

5. The throttle opening control arrangement of claim 4 wherein said throttle position regulating system controls a regulated angle of throttle opening, which regulated angle of throttle, opening is defined by the angular distance between said first abutting surface and said second abutting surface about said axis defined by said first shaft.

6. The throttle opening control arrangement of claim 5 wherein said throttle position regulating system further includes a means for fine tuning said regulated angle of throttle opening.

7. The throttle opening control arrangement of claim 5 wherein said throttle position regulating system further includes a set bolt and a threaded bolt receiving passage, wherein said threaded bolt receiving passage is positioned upon said stopper member, and said set bolt is held within said threaded bolt receiving passage; and wherein said first abutting surface is comprised of an end surface of said set bolt.

8. The throttle opening control arrangement of claim 7 wherein said set bolt is adjustable along its longitudinal length within said threaded bolt receiving passage, via rotation of said set bolt, for fine tuning said regulated angle of throttle opening.

9. The throttle opening control arrangement of claim 5 wherein said throttle position regulating system further includes a flange extending off of said throttle control lever; and wherein said second abutting surface is comprised of a surface of said flange.

10. The throttle opening control arrangement of claim 5 wherein said first abutting surface engages said second abutting surface upon shifting from said operative running stage to said neutral stage when said set throttle opening angle exceeds said regulated angle of throttle opening, in order to decrease the angle of throttle opening without separately adjusting said second operator interfacing device.

* * * * *